US012228321B2

(12) United States Patent
Goncalez Ribeiro et al.

(10) Patent No.: US 12,228,321 B2
(45) Date of Patent: Feb. 18, 2025

(54) ADJUSTABLE COOLING SYSTEM

(71) Applicant: WHIRLPOOL CORPORATION, Benton Harbor, MI (US)

(72) Inventors: Andre Goncalez Ribeiro, St. Joseph, MI (US); Akshit Markan, Benton Harbor, MI (US); Ryan Gregory Wasielewski, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 18/523,066

(22) Filed: Nov. 29, 2023

(65) Prior Publication Data

US 2024/0102709 A1 Mar. 28, 2024

Related U.S. Application Data

(63) Continuation of application No. 16/703,031, filed on Dec. 4, 2019, now Pat. No. 11,885,544.

(51) Int. Cl.

| | |
|---|---|
| ***F25B 49/02*** | (2006.01) |
| ***F25B 5/04*** | (2006.01) |
| ***F25B 41/22*** | (2021.01) |
| ***F25B 41/31*** | (2021.01) |
| *F25B 41/20* | (2021.01) |
| *F25B 41/30* | (2021.01) |
| *F25B 43/00* | (2006.01) |

(52) U.S. Cl.

CPC ..... *F25B 49/02* (2013.01); *F25B 5/04* (2013.01); *F25B 41/22* (2021.01); *F25B 41/31* (2021.01); *F25B 41/20* (2021.01); *F25B 41/30* (2021.01); *F25B 43/006* (2013.01); *F25B 2313/0311* (2013.01); *F25B 2400/06* (2013.01); *F25B 2400/23* (2013.01); *F25B 2600/2513* (2013.01); *F25B 2700/191* (2013.01); *F25B 2700/1933* (2013.01); *F25B 2700/197* (2013.01); *F25B 2700/21174* (2013.01); *F25B 2700/21175* (2013.01); *F25D 2700/12* (2013.01)

(58) Field of Classification Search

CPC ..... F25B 49/02; F25B 41/31; F25B 41/22; F25B 5/04; F25B 2700/12

See application file for complete search history.

(56) References Cited

U.S. PATENT DOCUMENTS

| | | | |
|---|---|---|---|
| 2,712,732 | A | 7/1955 | Mcgrew |
| 4,261,180 | A | 4/1981 | Nozawa et al. |
| 4,910,972 | A | 3/1990 | Jaster |
| 5,134,859 | A | 8/1992 | Jaster |
| 5,406,805 | A | 4/1995 | Radermacher et al. |
| 5,477,915 | A | 12/1995 | Park |
| 5,758,510 | A | 6/1998 | Cho |

(Continued)

OTHER PUBLICATIONS

Parker Hannifin Corporation, Electric Valves, Bulletin 100-9, Sporlan Division (2007) (Year: 2007).

*Primary Examiner* — Nael N Babaa

(74) *Attorney, Agent, or Firm* — Price Heneveld LLP

(57) ABSTRACT

A refrigeration system comprises a variable speed compressor and a first evaporator. A second evaporator is operably coupled in series with the first evaporator. A first valve is coupled to the variable speed compressor and the first evaporator. A second valve is fluidly coupled to the second evaporator, and a pressure regulator is coupled to the second valve.

20 Claims, 5 Drawing Sheets

(56) References Cited

U.S. PATENT DOCUMENTS

| | | | | |
|---|---|---|---|---|
| 6,266,968 | B1 | 7/2001 | Redlich | |
| 6,775,998 | B2 | 8/2004 | Yuasa et al. | |
| 6,935,127 | B2 | 8/2005 | Jeong et al. | |
| 10,088,215 | B2 | 10/2018 | Klingshirn et al. | |
| 2006/0254308 | A1 | 11/2006 | Yokoyama et al. | |
| 2008/0314071 | A1 | 12/2008 | Ohta et al. | |
| 2011/0138825 | A1 | 6/2011 | Chen et al. | |
| 2012/0151948 | A1* | 6/2012 | Ogata | F04C 23/001 62/157 |
| 2012/0266624 | A1 | 10/2012 | Inaba et al. | |
| 2012/0291478 | A1* | 11/2012 | Kim | F25B 39/04 62/507 |
| 2014/0069118 | A1 | 3/2014 | Jung et al. | |
| 2015/0143836 | A1 | 5/2015 | Junge | |
| 2015/0253040 | A1 | 9/2015 | Aschan et al. | |
| 2015/0253045 | A1 | 9/2015 | Yamada et al. | |
| 2016/0320116 | A1 | 11/2016 | Klingshirn et al. | |
| 2018/0231277 | A1* | 8/2018 | Liengaard | F25B 41/37 |
| 2021/0172664 | A1 | 6/2021 | Goncalez Ribeiro et al. | |
| 2021/0372678 | A1 | 12/2021 | Engen | |

* cited by examiner

ADJUSTABLE COOLING SYSTEM

CROSS-REFERENCE TO RELATED APPLICATION

The present application is a continuation of U.S. patent application Ser. No. 16/703,031 filed Dec. 4, 2019, now U.S. Pat. No. 11,885,544, entitled ADJUSTABLE COOLING SYSTEM, the entire disclosure of which is hereby incorporated herein by reference.

BACKGROUND OF THE DISCLOSURE

The present disclosure generally relates to an adjustable cooling system, and more specifically, to an adjustable cooling system for an appliance.

SUMMARY OF THE DISCLOSURE

According to one aspect of the present disclosure, an appliance includes a variable speed compressor. A first evaporator is operably coupled to the variable speed compressor. A second evaporator is operably coupled in series to the first evaporator. An electronic expansion valve is in fluid communication to the second evaporator and is configured to regulate a flow of thermal exchange media from the first evaporator to the second evaporator.

According to another aspect of the present disclosure, a refrigeration system for an appliance includes a compressor and a first evaporator. A second evaporator is operably coupled to the first evaporator. An electronic expansion valve is configured to regulate a thermal exchange media from the first evaporator into the second evaporator. A pressure regulator is operably coupled to the electronic expansion valve and the first evaporator. A controller is configured to control the electronic expansion valve.

According to yet another aspect of the present disclosure, a refrigeration system includes a variable speed compressor and a first evaporator. A second evaporator is operably coupled in series with the first evaporator. A first valve is coupled to the variable speed compressor and the first evaporator. A second valve is fluidly coupled to the second evaporator, and a pressure regulator is coupled to the second valve.

These and other features, advantages, and objects of the present disclosure will be further understood and appreciated by those skilled in the art by reference to the following specification, claims, and appended drawings.

Figure 1:
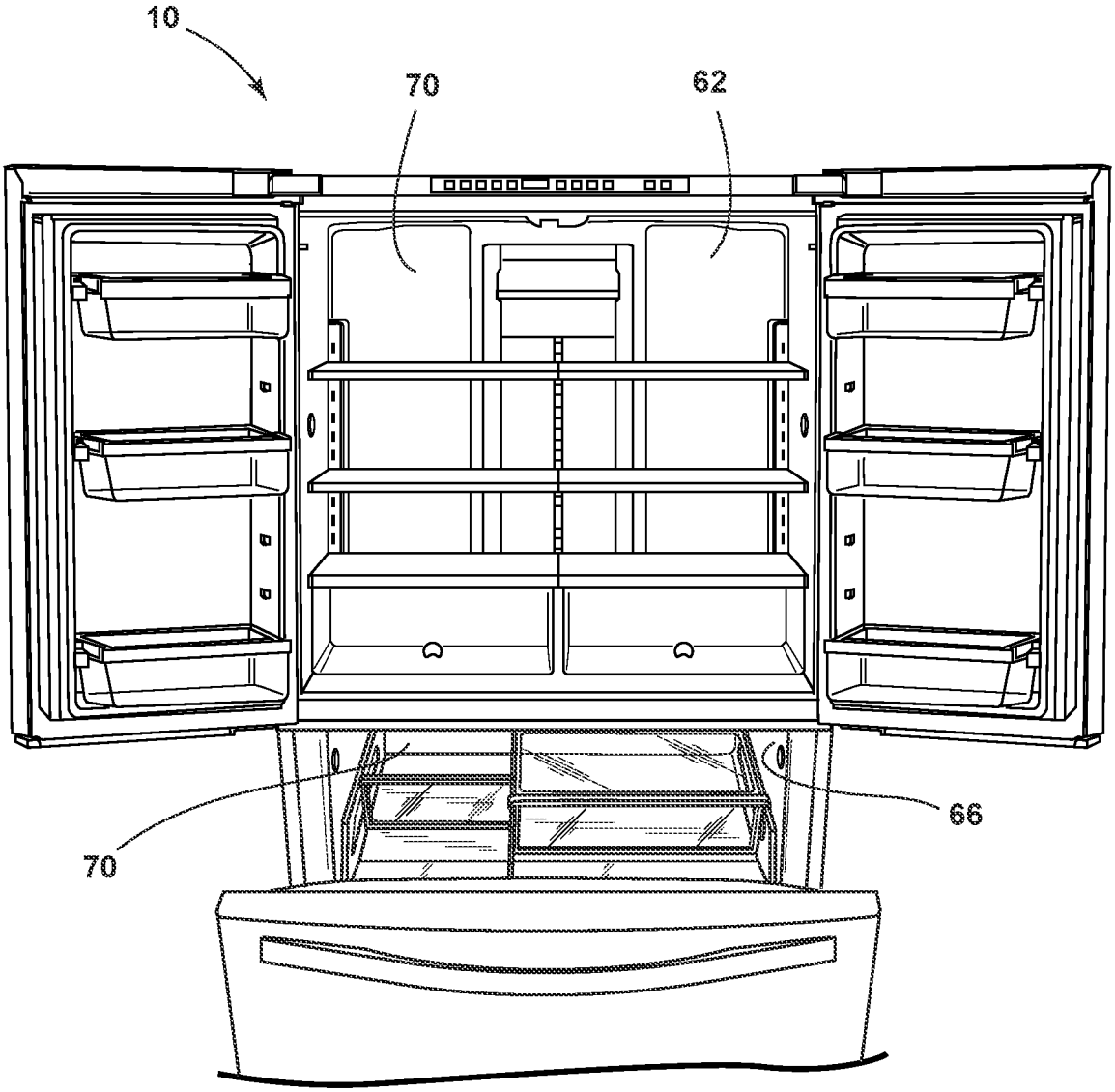
FIG. 1 is a front perspective view of an appliance of the present disclosure.
Figure 2:
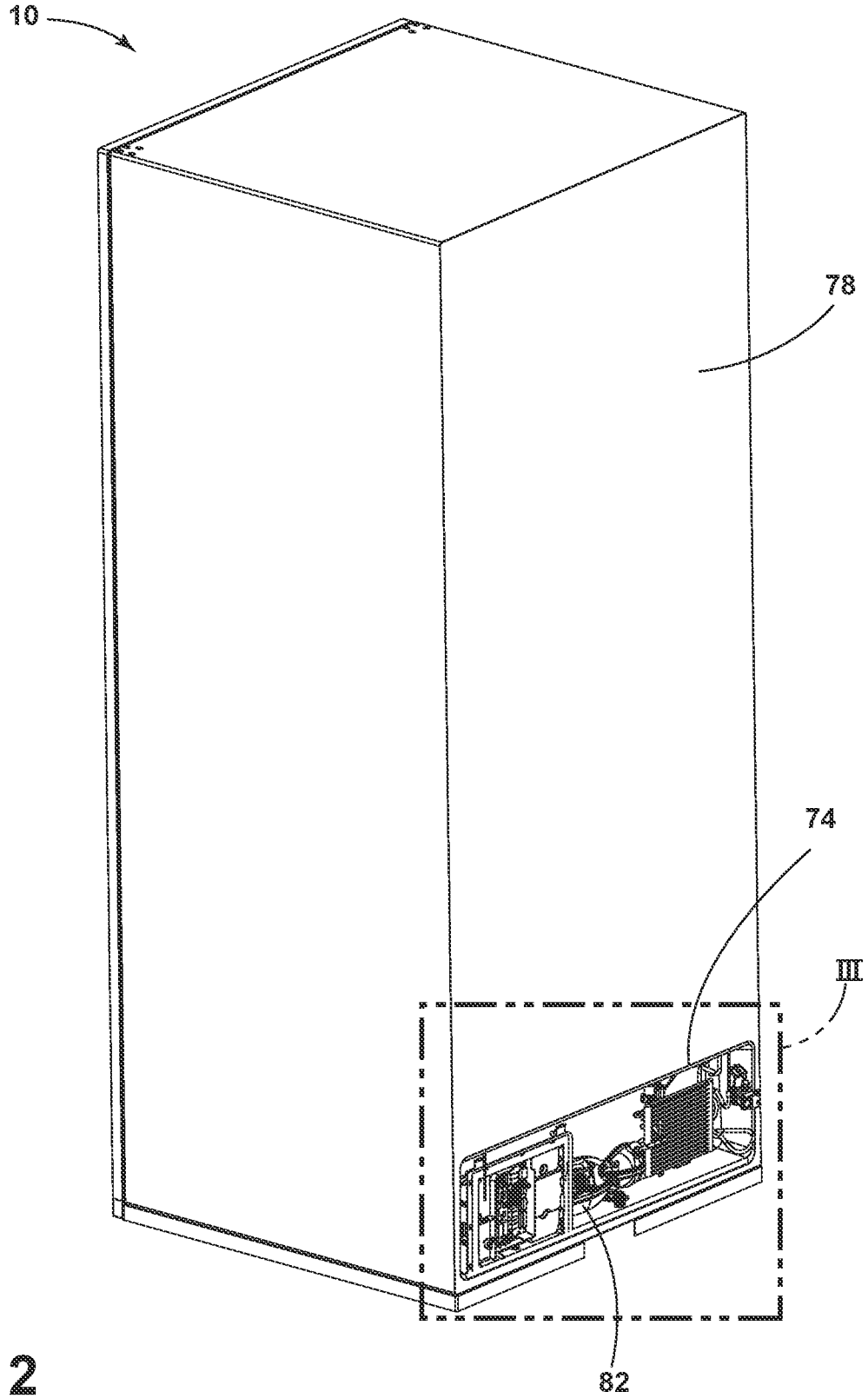
FIG. 2 is a rear perspective view of the appliance of FIG. 1 showing a machine compartment.

The components in the figures are not necessarily to scale, emphasis instead being placed upon illustrating the principles described herein.

DETAILED DESCRIPTION

The present illustrated embodiments reside primarily in combinations of method steps and apparatus components related to an adjustable cooling system. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-5, reference numeral 10 generally designates an appliance. The appliance 10 includes a variable speed compressor 14 and a first evaporator 18 operably coupled to the variable speed compressor 14. A second evaporator 22 is operably coupled in series to the first evaporator 18. An electronic expansion valve 26 is in fluid communication with the second evaporator 22 and is configured to regulate a flow 30 of thermal exchange media 34 from the first evaporator 18 to the second evaporator 22. A pressure regulator 38 is operably coupled to the electronic expansion valve 26, and a controller 42 is configured to regulate the electronic expansion valve 26.

An adjustable cooling system 50 includes a refrigerating cycle 54 and a freezing cycle 58. Each of the refrigerating and freezing cycles 54, 58 utilize, under varying conditions, the variable speed compressor 14, the first and second evaporators 18, 22, the electronic expansion valve 26, and the pressure regulator 38. Typically, the electronic expansion valve 26 is used to alter the adjustable cooling system 50. In one non-limiting example, the variable speed compressor 14 may be used to partially alter the adjustable cooling system 50. In a further non-limiting example, both the variable speed compressor 14 and the electronic expansion valve 26 may be used together to alter the adjustable cooling system 50.

Referring to FIGS. 1-5, the appliance 10 is illustrated as a French-door style refrigerator with a bottom-mounted drawer. It is also contemplated that the adjustable cooling system 50 can be used in other refrigeration constructions. The appliance 10 defines a refrigeration compartment 62 and a freezer compartment 66. Additionally, the refrigerating cycle 54 and the freezing cycle 58 control an internal environment 70 of each of the refrigeration and freezer compartments 62, 66, respectively. More specifically, the first evaporator 18 is primarily used for the cooling of the refrigeration compartment 62 during the refrigerating cycle 54. Additionally or alternatively, while the first evaporator 18 may also be used in cooling the freezer compartment 66, the second evaporator 22, in combination with the electronic expansion valve 26, is the primary regulator of the freezer compartment 66. The electronic expansion valve 26 may adjustably open and close to regulate the entry of the thermal exchange media 34 into the second evaporator 22, which helps control the cooling of the freezer compartment 66.

A machine compartment 74 generally defined by a rear portion 78 of the appliance 10 typically houses machine components 82 of the adjustable cooling system 50, including, but not limited to, the variable speed compressor 14 and a condenser 86. The first and second evaporators 18, 22, and the pressure regulator 38 are connected in series with the variable speed compressor 14 and the condenser 86. As the electronic expansion valve 26 is positioned in series with the first and second evaporators 18, 22, the electronic expansion valve 26 is typically positioned near the second evaporator 22. It is also contemplated that the adjustable cooling system 50 includes a first valve 90 as well as the electronic expansion valve 26, which, in such configurations, may be referred to as the second valve 26. The first valve 90 is typically positioned between the condenser 86 and the first evaporator 18. In addition, the first valve 90 can be constructed as a capillary tube such that the first valve 90 is open to the thermal exchange media 34 passing through the first valve 90. As the thermal exchange media 34 passes through the first valve 90, a portion of the thermal exchange media 34 is expanded into a lower pressure liquid state 98.

Figure 4:
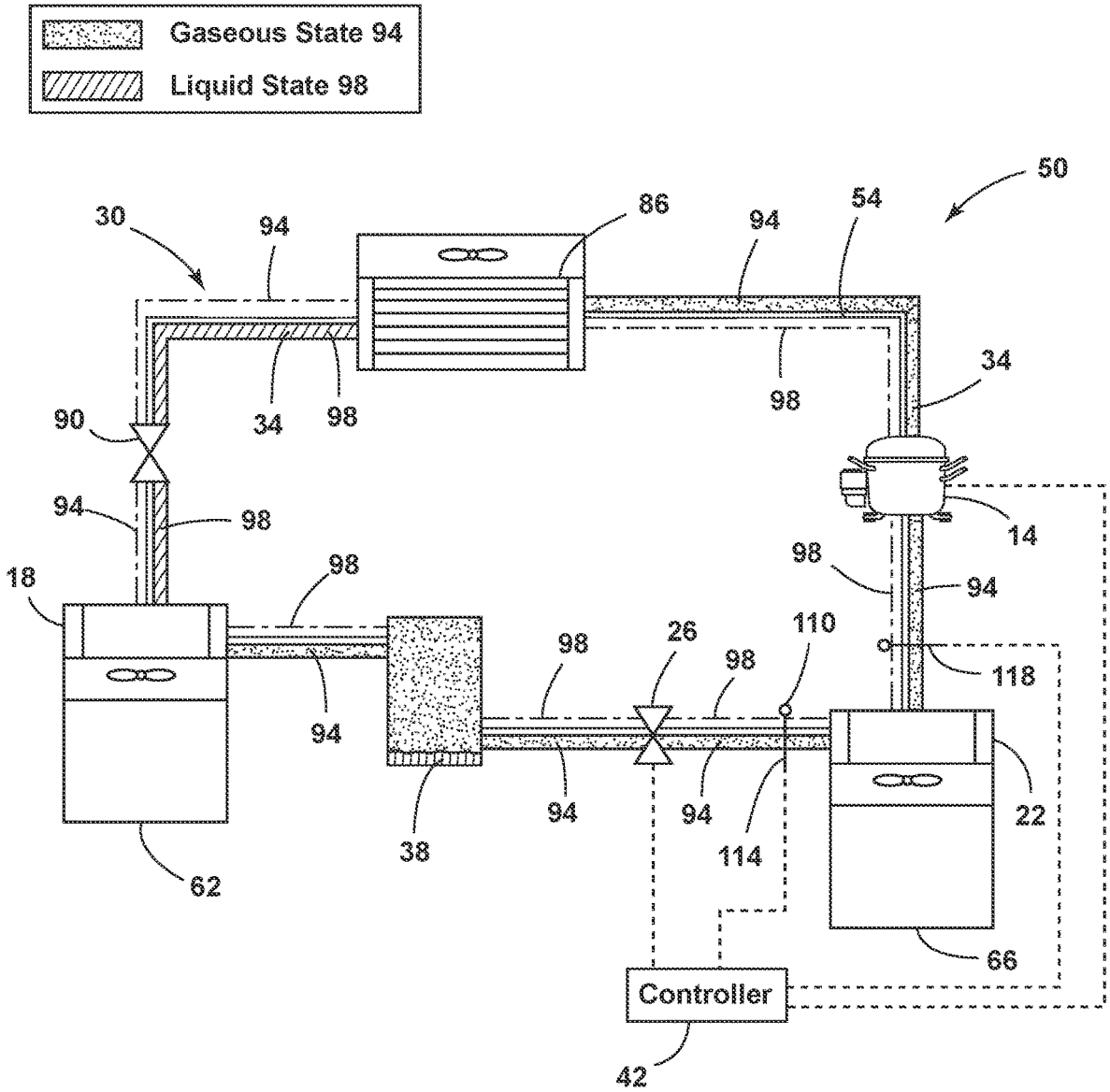
FIG. 4 is a schematic diagram of a refrigerating cycle of an adjustable cooling system of the present disclosure.
Figure 5:
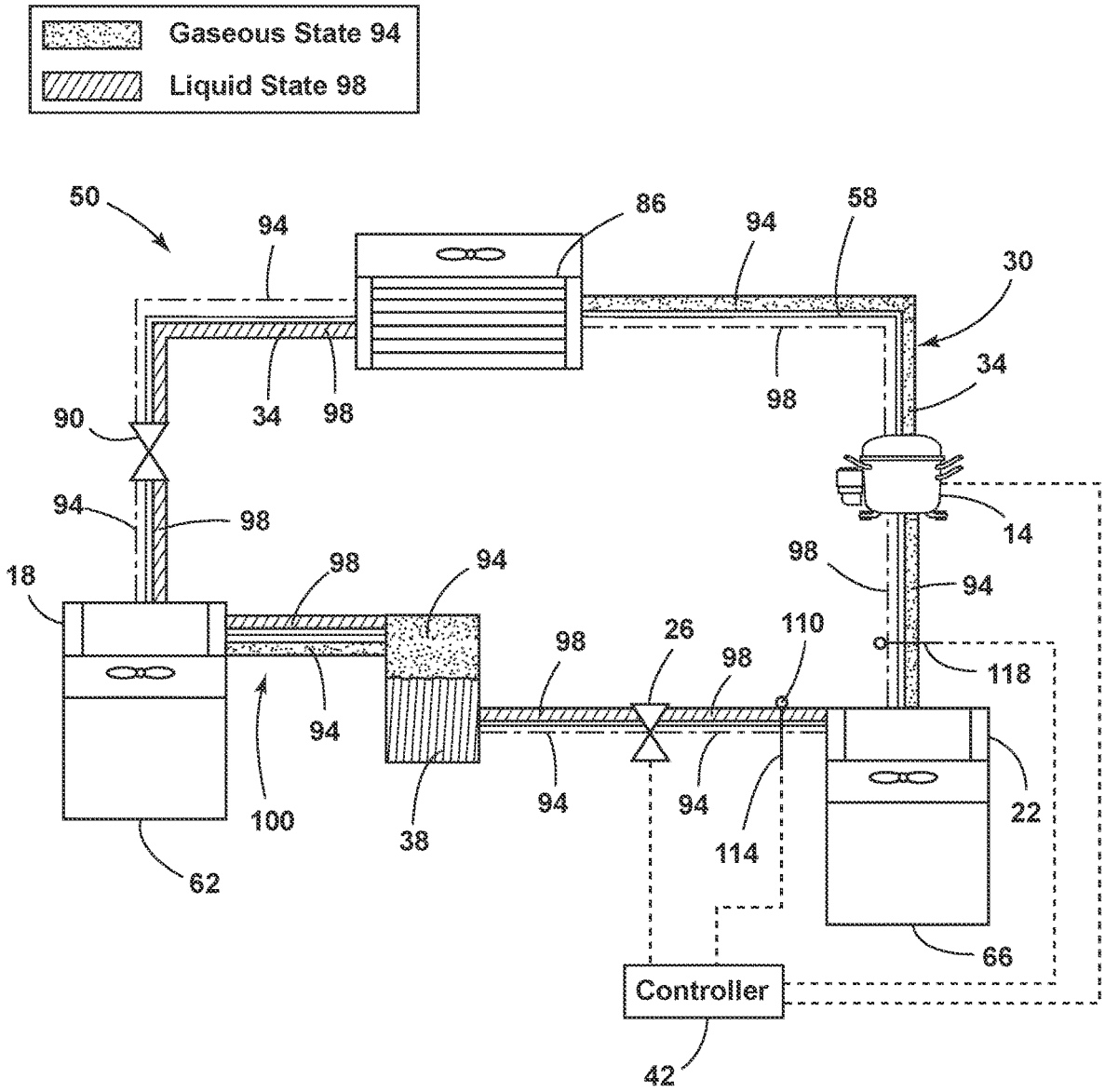
FIG. 5 is a schematic diagram of a freezing cycle of an adjustable cooling system of the present disclosure.

As illustrated in FIGS. 4 and 5, the portion of the thermal exchange media 34 in the gaseous state 94 is illustrated using a stipple pattern. The portion of the thermal exchange media 34 in the liquid state 98 is shown in a hatched pattern. As the thermal exchange media 34 moves through the adjustable cooling system 50, these states of the thermal exchange media 34 are utilized to provide cooling to the first and second evaporators 18, 22 and, in turn, the refrigeration compartment 62 and the freezer compartment 66. To achieve this, the state of the thermal exchange media 34, as it moves through the system 50 can be entirely in the gaseous state 94, entirely in the liquid state 98, or both. When either the gaseous state 94 or the liquid state 98 is not present at a point in the system 50, the respective state is illustrated by a broken line.

Figure 3:
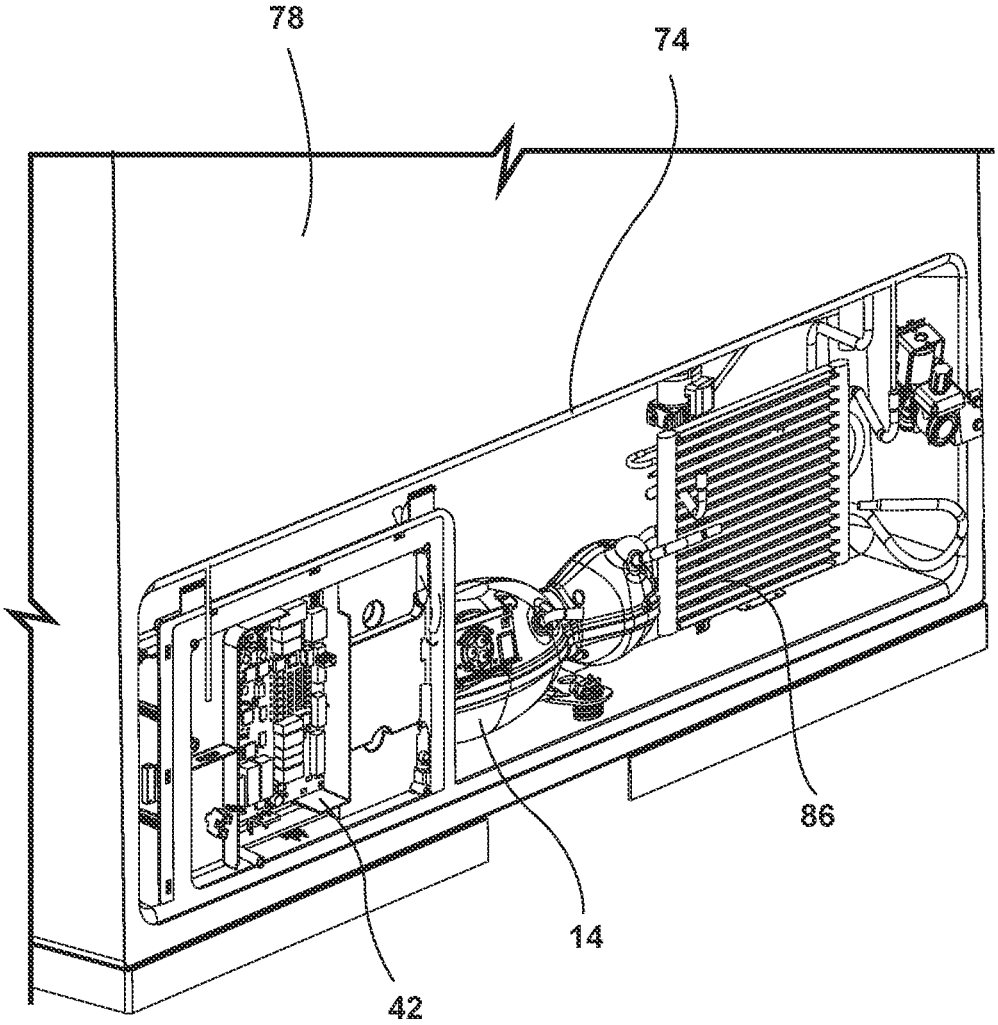
FIG. 3 is an expanded view of the machine compartment of FIG. 2 taken at area III.

Referring to FIGS. 3-5, the first valve 90 receives the thermal exchange media 34 from the condenser 86, which is coupled to the variable speed compressor 14. The condenser 86 is configured to condense the gaseous state 94 of the thermal exchange media 34 and into the liquid state 98 of the thermal exchange media 34. Stated differently, the thermal exchange media 34 in the gaseous state 94 travels from the variable speed compressor 14 to the condenser 86 where the thermal exchange media 34 is condensed from the gaseous state 94 into the liquid state 98. The thermal exchange media 34 in the liquid state 98 is then transferred through the first valve 90 where it is expanded. When a capillary tube is used for the first valve 90, the first valve 90 defines an initial pressure drop 92 that is fixed compared to a potential variable pressure drop across the electronic expansion valve 26. It is also contemplated that the first valve 90 may also be an electronic expansion valve similar to the electronic expansion valve 26 described herein. In either construction, the first valve 90 provides the initial pressure drop 92 within the adjustable cooling system 50.

As the thermal exchange media 34 leaves the first valve 90, the thermal exchange media 34 in the liquid state 98 enters the first evaporator 18. In the refrigerating cycle 54, depicted in FIG. 4, the thermal exchange media 34 is almost entirely evaporated by the first evaporator 18 into the gaseous state 94. After evaporation in the first evaporator 18, the thermal exchange media 34 in the gaseous state 94 moves through the pressure regulator 38, the electronic expansion valve 26, and the second evaporator 22 while substantially remaining in the gaseous state 94. For example, during the refrigerating cycle 54, the thermal exchange media 34 in the gaseous state 94 typically entirely passes through the pressure regulator 38. In addition, the electronic expansion valve 26 is set to be fully open during the refrigerating cycle 54, such that the thermal exchange media 34 can pass through with minimal regulation by the electronic expansion valve 26. The fan for the second evaporator 22 is typically off during the refrigerating cycle 54, such that as the thermal exchange media 34 passes through the second evaporator 22 there is minimal additional cooling.

In conventional cooling systems, a capillary tube is used to define at least the first pressure drop. Conventional refrigerating systems may also use a second capillary tube to define subsequent pressure drops. The pressure drops in a conventional cooling system are unregulated by the first and second capillary tubes because capillary tubes operate in a binary fashion. For example, capillary tubes used in conventional cooling systems typically operate as open or closed without partial adjustments between open and closed.

Referring still to FIGS. 3-5, during the freezing cycle 58 and after expansion by the first valve 90, the thermal exchange media 34 in the liquid state 98 is transferred to the first evaporator 18. In the first evaporator 18, the expanded thermal exchange media 34 will be at least partially evaporated, such that some of the thermal exchange media 34 is in the gaseous state 94 as it leaves the first evaporator 18. In addition, some of the thermal exchange media 34 remains in the liquid state 98 after moving out of the first evaporator 18. Accordingly, during the freezing cycle 58, the thermal exchange media 34 will exit the first evaporator 18 while in an intermediate state 100. The intermediate state 100 is defined as some of the thermal exchange media 34 being in the gaseous state 94 and the remainder of the thermal exchange media 34 being in the liquid state 98.

It is contemplated that in the intermediate state 100, after exiting the first evaporator 18, the thermal exchange media 34 will be primarily in the gaseous state 94 with only a small amount of the thermal exchange media 34 existing in the liquid state 98. Additionally or alternatively, the thermal exchange media 34 may be only partially in the gaseous state 94 when exiting the first evaporator 18. Thus, it is also contemplated that the intermediate state 100 may be defined as the thermal exchange media 34 primarily in the liquid state 98. The distribution of the thermal exchange media 34 in the gaseous and liquid states 94, 98 while in the intermediate state 100 may depend on the cooling specifications of the adjustable cooling system 50 in relation to the cooling specifications and temperature preferences and settings of each of the refrigeration and freezer compartments 62, 66.

The thermal exchange media 34, in either the intermediate state 100 or the gaseous state 94, is then transferred from the first evaporator 18 into the pressure regulator 38. Accordingly, the pressure regulator 38 is operably coupled to and in fluid communication with the first evaporator 18. The pressure regulator 38 is typically a flash chamber that is configured to separate the thermal exchange media 34 in the gaseous state 94 from the thermal exchange media 34 in the liquid state 98. As the thermal exchange media 34 continues to move through the adjustable cooling system 50, the separation of the gaseous state 94 and the liquid state 98 is dependent upon whether the refrigerating cycle 54 or the freezing cycle 58 is in operation.

When the refrigerating cycle 54 is being operated, the thermal exchange media 34 typically passes through the pressure regulator 38 in either the gaseous state 94 or the intermediate state 100 and into the electronic expansion valve 26. It is generally contemplated that during the refrigerating cycle 54 the thermal exchange media 34 is in the gaseous state 94 once the thermal exchange media 34 exits the first evaporator 18 and enters the pressure regulator 38. Alternatively, if the freezing cycle 58 is operated, then the pressure regulator 38 will separate the thermal exchange media 34 into the gaseous state 94 and the liquid state 98. The pressure regulator 38 will then hold the thermal exchange media 34 in the gaseous state 94 until the subsequent refrigerating cycle 54 is activated. Accordingly, the pressure regulator 38 separates the vapor and the liquid of the thermal exchange media 34 to regulate the pressure of the adjustable cooling system 50 depending on the cycle.

Referring again to FIGS. 3-5, during the refrigerating cycle 54, all of the thermal exchange media 34, regardless of whether in the gaseous state 94 or the liquid state 98, is transferred through the electronic expansion valve 26. Additionally or alternatively, during the freezing cycle 58, the thermal exchange media 34 in the gaseous state 94 is retained within the pressure regulator 38. In addition, the thermal exchange media 34 in the liquid state 98 is transferred from the pressure regulator 38 through the electronic expansion valve 26. Accordingly, the thermal exchange media 34 in the gaseous state 94 is retained in the pressure regulator 38 until the next refrigerating cycle 54 is activated, as will be described more fully below.

While the pressure regulator 38 may at least partially separate the thermal exchange media 34, it is contemplated that the flow of the thermal exchange media 34 between the first evaporator 18 and the second evaporator 22 is ultimately regulated by the electronic expansion valve 26. Accordingly, the electronic expansion valve 26 is in fluid communication with both the first and second evaporators 18, 22. Depending on the cycle run in the adjustable cooling system 50, the thermal exchange media 34 can enter the electronic expansion valve 26 in either the liquid state 98 or the gaseous state 94. As mentioned above, the thermal exchange media 34 enters the electronic expansion valve 26 in the gaseous state 94 during the refrigerating cycle 54, such that the thermal exchange media 34 is evaporated by the first evaporator 18. The resultant thermal exchange media 34 in the gaseous state 94 runs through the remainder of the adjustable cooling system 50 until it reaches the compressor 14, discussed in further detail below.

During the freezing cycle 58, the thermal exchange media 34 in the gaseous state 94 is temporarily stored in the pressure regulator 38 and the thermal exchange media 34 in the liquid state 98 is transferred to the electronic expansion valve 26. The electronic expansion valve 26 selectively expands the thermal exchange media 34 that is still in the liquid state 98 before transferring the expanded thermal exchange media 34 to the second evaporator 22. In selectively expanding, the controller 42 typically automatically adjusts the opening of the electronic expansion valve 26. This adjustment is generally based on the percentage of thermal exchange media 34 in the liquid state 98 that is entering the electronic expansion valve 26 from the pressure regulator 38. While the first valve 90 provides the initial pressure drop 92, the electronic expansion valve 26 selectively controls and defines the second pressure drop 102.

The second pressure drop 102 is regulated by the electronic expansion valve 26 and corresponds with the percentage of thermal exchange media 34 in the liquid state 98 that enters the electronic expansion valve 26. Such regulation provides advantageous energy efficiency within the adjustable cooling system 50. For example, the electronic expansion valve 26 can partially open in response to the percentage of thermal exchange media 34 that is entering the electronic expansion valve 26. Accordingly, when there is a lower percentage of thermal exchange media 34 in the liquid state 98 entering the electronic expansion valve 26, it is advantageous for the electronic expansion valve 26 to only partially open. Additionally or alternatively, when there is a high percentage of thermal exchange media 34 entering the electronic expansion valve 26, then the electronic expansion valve 26 can be operated to fully open to accommodate a larger pressure drop. This selective control of the electronic expansion valve 26 controls the superheating of the thermal exchange media 34 within the adjustable cooling system 50 in an efficient manner.

Typically, the thermal exchange media 34 enters the electronic expansion valve 26 at a higher pressure and in the liquid state 98. The remaining thermal exchange media 34 in the gaseous state 94 is retained in the pressure regulator 38, discussed in further detail below. After passing through the electronic expansion valve 26, the thermal exchange media 34 is in the intermediate state 100 at a lowered pressure. This change in pressure of the thermal exchange media 34 defines the second pressure drop 102. Once through the electronic expansion valve 26, the thermal exchange media 34 enters the second evaporator 22, typically at the lowered pressure. This change in pressure is communicated to the controller 42, which helps determine the rate at which thermal exchange media 34 is introduced into the second evaporator 22 from the electronic expansion valve 26.

Accordingly, it is also contemplated that a sensor 110 can be coupled to the electronic expansion valve 26. The sensor 110 can be a temperature sensor configured to sense the temperature of the thermal exchange media 34 as it passes through the second evaporator 22 from the electronic expansion valve 26. In such an embodiment, based on the sensed temperature, the sensor 110 sends a signal to the controller 42 generally indicating the temperature of the thermal exchange media 34 in the adjustable cooling system 50. The sensor 110 may also include an inlet sensor 114 and an outlet sensor 118 positioned upstream and downstream of the second evaporator 22 in the adjustable cooling system 50.

As the thermal exchange media 34 leaves the electronic expansion valve 26 in the intermediate state 100, the thermal exchange media 34 has a generally lowered pressure and lowered temperature. Once the thermal exchange media 34 passes through the coils of the second evaporator 22, the thermal exchange media 34 is evaporated and more completely enters the gaseous state 94. Accordingly, the inlet sensor 114 senses the temperature of the thermal exchange media 34 as it enters the second evaporator 22, and the outlet sensor 118 senses the temperature of the thermal exchange media 34 as it exits the second evaporator 22. Each of the inlet and outlet sensors 114, 118 are communicatively coupled to the controller 42, such that the inlet and outlet temperatures of the thermal exchange media 34 are sent to the controller 42 for comparison.

The controller 42 is also communicatively coupled to the electronic expansion valve 26. Accordingly, if the controller 42 detects that the difference in the inlet and outlet temperatures of the thermal exchange media 34 satisfy a set temperature for the adjustable cooling system 50, then the controller 42 will send a corresponding signal to the electronic expansion valve 26. The signal sent from the controller 42 to the electronic expansion valve 26 can result in an adjustment of the electronic expansion valve 26 where an adjusted difference in the inlet and outlet temperatures is desired.

In a non-limiting example, in condition A, if the temperature difference between the inlet and the outlet of the second evaporator 22 matches the set temperature of the refrigeration or freezer compartments, then the controller 42 typically sends a signal to the electronic expansion valve 26 to close. This is because the temperature in either the refrigeration or freezer compartment 62, 66 is sufficiently cooled as a result of the respective cycle. Additionally or alternatively, in condition B, the controller 42 typically sends a signal to the electronic expansion valve 26 to partially close, thereby reducing the amount of thermal exchange media 34 entering the second evaporator 22. This occurs when the thermal exchange media 34 is approaching a temperature that correlates with the set temperature of the freezer compartment 34, so the electronic expansion valve 26 can slow the entry of thermal exchange media 34 into the second evaporator 22 to regulate additional cooling of the freezer compartment 66.

In condition C, the controller 42 typically sends a signal to the electronic expansion valve 26 to open further to allow more thermal exchange media 34 to enter the second evaporator 22. This typically occurs during the refrigerating cycle 54 or during a pump-out cycle between the freezing and refrigerating cycles 58, 54.

During the freezing cycle 58, thermal exchange media 34 in the gaseous state 94 is retained in the pressure regulator 38. To release the thermal exchange media 34 in the gaseous state 94 from the pressure regulator 38, the refrigerating cycle 54 may be run, which will consequently push through any additional thermal exchange media 34 in the gaseous state 94. It is also contemplated that there may be a separate cycle known as the pump-out cycle that flushes the adjustable cooling system 50, and ultimately flushes the pressure regulator 38, of remaining thermal exchange media 34 in the gaseous state 94 prior to starting a new refrigerating cycle 54.

Once the thermal exchange media 34 is within the second evaporator 22, it is typically evaporated entirely, or almost entirely, into the gaseous state 94 as the thermal exchange media 34 exits the second evaporator 22. In the gaseous state 94 exiting the second evaporator 22, the thermal exchange media 34 has a lowered pressure. The thermal exchange media 34 is then transferred to the compressor 14 that is fluidly coupled to the second evaporator 22 and the cycle begins again.

The compressor 14 may be an on/off compressor as is typically used in cooling systems, such as the adjustable cooling system 50. In such configurations, the compressor 14 controls the temperature of the adjustable cooling system 50 to the extent that the compressor 14 restricts the flow of the thermal exchange media 34. While the compressor 14 controls the temperature and pressure of the adjustable cooling system 50 to the extent that the compressor 14 is on or off, in such configurations the electronic expansion valve 26 is the primary regulator of the temperature and pressure within the adjustable cooling system 50. Accordingly, the electronic expansion valve 26, in combination with the signals received by the controller 42, will adjust to being partially or fully open or closed depending on the cooling specifications of the adjustable cooling system 50.

As mentioned above, it is also contemplated that the compressor 14 may be a variable speed compressor 14. In such configuration, both the variable speed compressor 14 and the electronic expansion valve 26 will control the temperature of the adjustable cooling system 50. For example, if the controller 42 receives a signal from the sensor 110 that the temperature of the adjustable cooling system 50 is higher than specified, then the controller 42 sends a signal to the variable speed compressor 14, the electronic expansion valve 26, or both. Either or both of the electronic expansion valve 26 and the variable speed compressor 14 operates to adjust the flow rate of the thermal exchange media 34. By way of example, and not limitation, during the refrigerating cycle 54, the variable speed compressor 14 can be used to adjust the rate at which the thermal exchange media 34 exits the variable speed compressor 14. This adjustment of the rate can accommodate a specified temperature of the adjustable cooling system 50. In combination with the variable speed compressor 14, the electronic expansion valve 26 will also adjust the rate at which the thermal exchange media 34 flows through the adjustable cooling system 50. Further, the electronic expansion valve 26 is communicatively coupled to the variable speed compressor 14 via the controller 42 to execute the adjustment. Ultimately, the controller 42, based on signals received from the sensor 110, communicates with the variable speed compressor 14 and the electronic expansion valve 26 to control the flow rate of the thermal exchange media 34.

The combination of the variable speed compressor 14 and the electronic expansion valve 26 is advantageous for efficient performance over the adjustable cooling system 50. The controller 42 sets the variable speed compressor 14 to a speed that will provide the most efficient cooling within the adjustable cooling system 50. Additionally, the controller 42 may also adjust the electronic expansion valve 26 to operate so as to provide efficient cooling within the adjustable cooling system 50. The sensors 114, 118 may also communicate directly with the electronic expansion valve 26. Each of these adjustments result in the variable speed compressor 14 and the electronic expansion valve 26 operating at a specified speed or configuration as quickly as possible without the process of ramping up to the set speed or configuration. For example, the specified efficient speed for the variable speed compressor 14 may be a high speed. The controller 42 is configured to communicate with the variable speed compressor 14 to adjust to the high speed without first slowly ramping up to that higher speed. Similarly, the electronic expansion valve 26 can be adjusted from a fully closed position to an open position and any point in between (i.e. partially open) without first proceeding through various intermediary steps.

Conventional cooling systems may set a temperature, but it takes time to reach the set temperature. Thus, the process used by conventional cooling systems wastes energy and is ultimately inefficient. Moreover, conventional cooling systems typically utilize a compressor that only functions in the on/off configuration, such that the conventional compressor does not alter or adjust the rate at which a fluid may pass through the conventional cooling system. Moreover, such conventional compressors are typically combined with a capillary tube, not an electrical valve.

Accordingly, it is advantageous and increases the efficiency of the adjustable cooling system 50 to incorporate the variable speed compressor 14 and the electronic expansion valve 26 into the adjustable cooling system 50. The variable speed compressor 14 helps regulate the rate at which the thermal exchange media 34 moves through the various components of the adjustable cooling system 50 by operating at a set speed to reach a set temperature. In addition, the electronic expansion valve 26 regulates the flow rate of the thermal exchange media 34 by adjusting the opening of the valve, thus, controlling the rate at which the thermal exchange media 34 enters the second evaporator 22. It is also contemplated, for added efficiency, that the first valve 90 may also be constructed from an electronic valve similar to the electronic expansion valve 26 described herein and as mentioned above.

The invention disclosed herein is further summarized in the following paragraphs and is further characterized by combinations of any and all of the various aspects described therein.

According to one aspect of the present disclosure, an appliance includes a variable speed compressor. A first evaporator is operably coupled to the variable speed compressor. A second evaporator is operably coupled in series to the first evaporator. An electronic expansion valve is in fluid communication to the second evaporator and is configured to regulate a flow of thermal exchange media from the first evaporator to the second evaporator.

According to another aspect, an electronic expansion valve selectively expands a refrigerating fluid. The expanded refrigerating fluid is transferred to a second evaporator.

According to yet another aspect, an electronic expansion valve is positioned between and in series with a first evaporator and a second evaporator.

According to still another aspect, a pressure regulator is a flash chamber that is configured to separate a thermal exchange media in a gaseous state from the thermal exchange media in a liquid state. The separated liquid state is in fluid communication with an electronic expansion valve.

According to another aspect, an electronic expansion valve defines a first mode and a second mode. The first mode is a high flow state. The second mode is a low flow state.

According to another aspect, a controller is configured to switch an electronic expansion valve between a first mode and a second mode.

According to yet another aspect, a first evaporator, a pressure regulator, an electronic expansion valve, and a second evaporator is operably coupled in series.

According to another aspect of the present disclosure, a refrigeration system for an appliance includes a compressor and a first evaporator. A second evaporator is operably coupled to the first evaporator. An electronic expansion valve is configured to regulate a thermal exchange media from the first evaporator into the second evaporator. A pressure regulator is operably coupled to the electronic expansion valve and the first evaporator. A controller is configured to control the electronic expansion valve.

According to another aspect, a compressor is a variable speed compressor.

According to yet another aspect, a refrigeration system further includes a sensor that is communicatively coupled to a controller. The controller is configured to open or close an electronic expansion valve in response to a signal that is received from a sensor.

According to still another aspect, a sensor is a temperature sensor that is coupled to a tube positioned between a first evaporator and a second evaporator.

According to another aspect, an electronic expansion valve includes a plurality of rates. A controller is configured to adjust the electronic expansion valve to a corresponding rate of the plurality of rates in response to a signal from a sensor.

According to yet another aspect, a pressure regulator is a flash chamber that is configured to separate a thermal exchange media in a gaseous state from the thermal exchange media in a liquid state. The flash chamber is operably coupled in series to an electronic expansion valve.

According to still another aspect, an electronic expansion valve is fluidly coupled to a first evaporator and a second evaporator to regulate the flow of a thermal exchange media to the second evaporator in response to a controller.

According to yet another aspect of the present disclosure, a refrigeration system includes a variable speed compressor and a first evaporator. A second evaporator is operably coupled in series with the first evaporator. A first valve is coupled to the variable speed compressor and the first evaporator. A second valve is fluidly coupled to the second evaporator, and a pressure regulator is coupled to the second valve.

According to another aspect, a second valve is an electronic expansion valve that is communicatively coupled to a controller.

According to yet another aspect, a refrigeration system further includes a sensor that is communicatively coupled to a controller. The controller receives a signal from a sensor and adjusts an electronic expansion valve in response to the signal.

According to still another aspect, a variable speed compressor is in communication with a controller and is configured to regulate a flow rate of a thermal exchange media in response to a signal that is received by the controller.

According to another aspect, a pressure regulator and a second valve are operably coupled to and positioned in series between a first valve and a second evaporator.

According to another aspect, a second valve includes a first mode and a second mode. The first mode is a high flow state, and a second mode is a low flow state.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A refrigeration system for an appliance, the refrigeration system comprising:

a thermal exchange media that is delivered through a sequential path and changes between a liquid state and a gaseous state;

a first evaporator and a second evaporator that are each operably coupled to the sequential path;

an electronic expansion valve coupled to the sequential path and in fluid communication to the second evaporator and configured to regulate a flow of the thermal exchange media from the first evaporator to the second evaporator, the electronic expansion valve configured to selectively open and close based on a percentage of the thermal exchange media that is in the liquid state and the gaseous state as the thermal exchange media enters the electronic expansion valve in the liquid state and the gaseous state;

a flash chamber operably and directly coupled to the electronic expansion valve via the sequential path, wherein the flash chamber separates the thermal exchange media in the gaseous state from the thermal exchange media in the liquid state; and a controller that operates the electronic expansion valve in a partially open state to regulate superheating of the thermal exchange media, wherein all of the thermal exchange media recirculates sequentially, and in series, through each of the first evaporator, the flash chamber, the electronic expansion valve and the second evaporator, wherein the electronic expansion valve defines a first mode and a second mode, wherein the first mode is a high flow state and the second mode is a low flow state, wherein the electronic expansion valve cooperates with the flash chamber and the thermal exchange media separated therein to regulate the percentage of the thermal exchange media that is in the liquid state as the thermal exchange media enters the electronic expansion valve.

2. The refrigeration system of claim 1, further comprising a compressor that delivers the thermal exchange media through the sequential path.

3. The refrigeration system of claim 1, wherein the electronic expansion valve selectively expands the thermal exchange media, and wherein the expanded thermal exchange media is transferred to the second evaporator.

4. The refrigeration system of claim 1, wherein the separated thermal exchange media in the liquid state is in fluid communication with the electronic expansion valve.

5. The refrigeration system of claim 1, wherein the controller is configured to switch the electronic expansion valve between the first mode and the second mode.

6. The refrigeration system of claim 1, wherein the first evaporator, the flash chamber, the electronic expansion valve, and the second evaporator are operably coupled in series.

7. A refrigeration system for an appliance, comprising:

a plurality of evaporators;

an electronic expansion valve configured to selectively regulate a thermal exchange media sequentially and in series through the plurality of evaporators, the electronic expansion valve operable in at least a partially open state that regulates a pressure drop based on a percentage of the thermal exchange media in a liquid state and a gaseous state entering the electronic expansion valve in the liquid state and the gaseous state;

a flash chamber operably coupled to the electronic expansion valve via a single conduit and operably coupled to a first evaporator of the plurality of evaporators, wherein the flash chamber is configured to separate the thermal exchange media in the gaseous state from the thermal exchange media in the liquid state, wherein the flash chamber directs the thermal exchange media in the gaseous state and the liquid state to the electronic expansion valve, wherein the flash chamber is operably coupled in series with the first evaporator and the electronic expansion valve; and a controller configured to control the electronic expansion valve, wherein all of the thermal exchange media is recirculated sequentially, and in series, through each of the first evaporator, the flash chamber, the electronic expansion valve and a second evaporator of the plurality of evaporators.

8. The refrigeration system of claim 7, further comprising a variable speed compressor that recirculates the thermal exchange media sequentially, and in series, through each of the variable speed compressor, the first evaporator, the flash chamber, the electronic expansion valve and the second evaporator of the plurality of evaporators.

9. The refrigeration system of claim 7, wherein the refrigeration system further includes a sensor communicatively coupled to the controller, wherein the controller is configured to open or close the electronic expansion valve in response to a signal received from the sensor.

10. The refrigeration system of claim 9, wherein the sensor is a temperature sensor coupled to a tube positioned between the first and second evaporators.

11. The refrigeration system of claim 10, wherein the electronic expansion valve includes a plurality of rates, wherein the controller is configured to adjust the electronic expansion valve to a corresponding rate of the plurality of rates in response to the signal from the sensor.

12. The refrigeration system of claim 11, wherein the plurality of rates are defined by a first mode and a second mode, wherein the first mode is a high flow state and the second mode is a low flow state.

13. The refrigeration system of claim 7, wherein the electronic expansion valve is fluidly coupled to the first and second evaporators to regulate a flow of the thermal exchange media to the second evaporator in response to the controller.

14. A refrigeration system, comprising:

a first evaporator;

a second evaporator operably coupled in series with the first evaporator;

a first valve coupled to a variable speed compressor and the first evaporator;

a second valve fluidly coupled to the second evaporator and operable in a partially open state;

a flash chamber directly coupled to the second valve via a single conduit;

a thermal exchange media that changes between a gaseous state and a liquid state as the thermal exchange media is recirculated sequentially and in series through each of the variable speed compressor, the first valve, the first evaporator, the flash chamber, the second valve and the second evaporator; and a controller communicatively coupled to the second valve and configured to selectively open the second valve based on a percentage of the thermal exchange media in the liquid state and the gaseous state entering the second valve from the flash chamber, wherein the flash chamber is configured to separate the thermal exchange media in the gaseous state from the thermal exchange media in the liquid state, wherein the second valve is an electronic expansion valve that defines a first mode and a second mode, wherein the first mode is a high flow state and the second mode is a low flow state, wherein the electronic expansion valve cooperates with the flash chamber and the thermal exchange media separated therein to regulate the percentage of the thermal exchange media that is in the liquid state as the thermal exchange media enters the electronic expansion valve.

15. The refrigeration system of claim 14, wherein the refrigeration system further includes a sensor communicatively coupled to the controller, wherein the controller receives a signal from the sensor and adjusts the electronic expansion valve in response to the signal.

16. The refrigeration system of claim 15, wherein the variable speed compressor is in communication with the controller and is configured to regulate a flow rate of the thermal exchange media in response to the signal received by the controller.

17. The refrigeration system of claim 14, wherein the flash chamber and the second valve are operably coupled to and positioned in series between the first valve and the second evaporator.

18. The refrigeration system of claim 1, further comprising:

an inlet sensor that is positioned upstream of the second evaporator; and an outlet sensor that is positioned downstream of the second evaporator, wherein the inlet sensor and the outlet sensor are in communication with the controller to monitor the temperatures of the thermal exchange media relative to the second evaporator.

19. The refrigeration system of claim 18, wherein the controller determines a temperature difference of the thermal exchange media based on temperature information from the inlet sensor and the outlet sensor, and based on the temperature difference, the controller operates the electronic expansion valve between a closed state, the partially open state, and a fully open state.

20. The refrigeration system of claim 7, further comprising an inlet temperature sensor that is positioned upstream of the second evaporator; and an outlet temperature sensor that is positioned downstream of the second evaporator, wherein the controller determines a temperature difference of the thermal exchange media based on temperature information received from the inlet temperature sensor and the outlet temperature sensor, and wherein based on the temperature difference, the controller operates the electronic expansion valve between a closed state, the partially open state, and a fully open state.

* * * * *